United States Patent [19]

Spademan

[11] 4,429,896

[45] Feb. 7, 1984

[54] STEP-IN SKI BINDING

[76] Inventor: Richard G. Spademan, Box 6410, Incline Village, Nev. 89450

[21] Appl. No.: 298,392

[22] Filed: Sep. 1, 1981

Related U.S. Application Data

[63] Continuation of Ser. No. 1,688, Jan. 8, 1981, abandoned.

[51] Int. Cl.[3] ..... A63C 9/10

[52] U.S. Cl. ..... 280/624; 280/629

[58] Field of Search ..... 280/623, 624, 626, 629, 280/11.3; 9/310 AA

[56] References Cited

U.S. PATENT DOCUMENTS 3,891,227 6/1975 Spademan ..... 280/624

4,145,071 3/1979 Saloman ..... 280/624

*Primary Examiner*—Joseph J. Rolla

*Assistant Examiner*—Kenneth Noland

*Attorney, Agent, or Firm*—Townsend and Townsend

[57] ABSTRACT

A step-in ski binding with a laterally movable side-clamping member (3,4), a step-in member (26,126) coupled to the side-clamping member (3,4), a force unit (20,146) for providing a clamping force and connecting members (11,27,110,127) for moving the movable side-clamping member (3,4) from its open position to its closed position as the step-in member (26,126) is moved from a clamp-opened position to a clamp-closed position and for applying the clamping force to the movable side-clamping members (3,4) as the step-in member (26,126) is further moved from its clamp-closed position to a clamping force applied position.

32 Claims, 20 Drawing Figures

2
29
35
20
27
31
10
1
1B
6
5
25
27
10
4
3
26
13
12
8
7
15
17
16
14
11
2

#2
35
22
29
35
38
#1
27
20
10
31
30
21
1T
1
27
26
1B
8
28
44
41
43
4
10
1T

FIG. 12
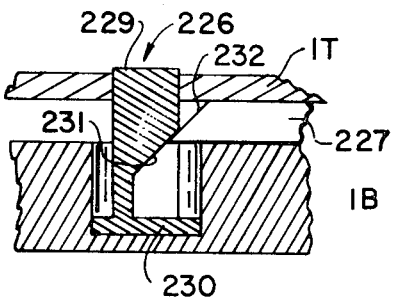
FIG. 13
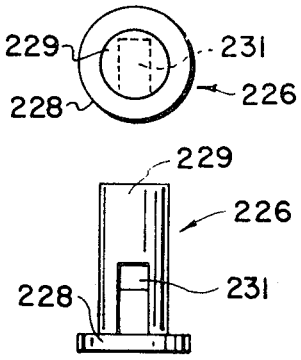
FIG. 14
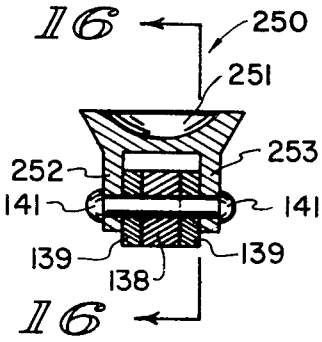
FIG. 15
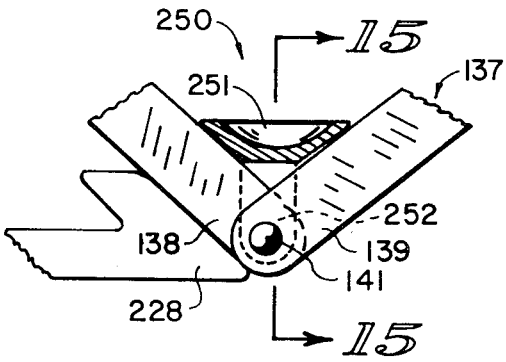
FIG. 16
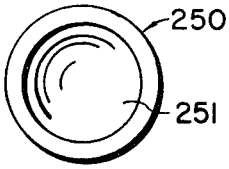
FIG. 17

STEP-IN SKI BINDING

This is a Continuation of application Ser. No. 1,688, filed Jan. 8, 1981, now abandoned.

BACKGROUND OF THE INVENTION

The present invention relates to ski bindings in general and in particular to releasable ski bindings having a mechanism by which entry into the binding is effected simply by stepping into the binding. Such bindings are commonly called step-in bindings.

In its simplest form, a releasable binding comprises one or more movable clamping members for releasably engaging one or more clamp-receiving members. The movable clamping members may be on the ski and the clamp-receiving members on the boot; or, alternatively, the location of the members may be reversed. To each of the movable clamping members there is coupled a mechanism, sometimes called a force unit, for applying a clamping force to the member. The mechanism for applying the clamping force to the movable clamping member may take several forms. One of the most common forms is a spring member. The spring member is particularly useful because it is relatively easy to use for applying a resilient clamping force to the movable clamping member. This is important for providing shock absorption and force adjustment. However, other mechanisms, such as electrical, magnetic, etc., may also be used for providing the necessary clamping force. Included among releasable bindings of the type referred to are the familiar toe-heel binding and the more recent side-clamp binding.

In the conventional toe-heel binding a clamping member is provided for clamping the toe and heel portions of a ski boot to a ski. In the conventional side-clamp binding there is provided a movable lateral clamping member for clamping the sides of a ski boot to a ski rearward of the toe and forward of the rear of the heel of the boot.

To facilitate clamping a ski boot to a ski, various step-in mechanisms have been proposed and incorporated in both the toe-heel and side-clamp type ski bindings.

In the conventional toe-heel type ski binding the step-in mechanism which allows a skier to step into a binding comprises a clamping member which is set to receive or is pre-loaded by a clamping force and is generally located at the rear and forms an integral part of the ski boot heel-clamping portion of the toe-heel binding. Typically the heel step-in mechanism is an overcenter type mechanism. In the mechanism a member is provided which extends forwardly of the mechanism to be engaged by the heel of a ski boot. To cock the mechanism and apply the clamping force to the clamping member, the forwardly extending member is moved to a raised position as by a strap, lever member or the like. As the heel of the ski boot is brought to bear thereon, the forwardly extending member is moved overcenter to a lower position wherein the full clamping force is applied to the heel of the ski boot for clamping the ski boot between the heel and toe clamping members. Manual cocking or resetting of the step-in mechanism is typically required prior to each re-entry of the binding.

In the side-clamp type binding, the step-in mechanisms which heretofore have been proposed are located at the heel of the ski boot or in a position to be contacted by the sole of the ski boot generally rearward of the toe and forward of the rear of the heel of the boot.

In the side-clamp type binding in which the step-in mechanism is located at the heel of the ski boot, there is provided, as in the conventional toe-heel type step-in binding, a member which extends forwardly of the mechanism to be engaged by the heel of the ski boot. As in the conventional toe-heel binding, to cock the mechanism and apply the clamping force to the clamping members, the forwardly extending member is moved to a raised position as by a strap, lever member or the like. In one such binding, to manually cock the binding, a force unit comprising a spring member is moved to a position wherein the force of the spring member is removed from the clamping members. When the force of the spring member is removed from the clamping members in this type of binding, the step-in mechanism, which is itself spring-loaded, is moved by its spring to engage a part of the clamping member. After the step-in mechanism engages the clamping member, the force unit is moved to its clamping position. With the force unit moved to its clamping position, the full clamping force of the spring member is restrained by the step-in mechanism from moving the clamping members to their closed or clamping position.

In use, as the heel of the ski boot is brought to bear on the forwardly extending member, the forwardly extending member is moved from its raised position to a lower position. As the forwardly extending member is moved to its lower position, it is disengaged from the clamping member, thereby allowing the clamping member to engage the ski boot or other clamp-receiving means attached to the ski boot with the full clamping force of the spring member.

One of the principal disadvantages of the step-in mechanism of the aforementioned side-clamp type binding is that is is necessary to provide a clearance space in the nature of a cutout in the heel of the boot for the forwardly extending heel-engaging member and parts of the step-in mechanism and force unit rearward thereof. The cutout in the heel portion of the ski boot is required to provide necessary clearance for the parts of this type of step-in mechanism and, in particular, to provide the clearance necessary for the step-in mechanism to automatically reset during involuntary release. Under certain conditions, the binding will cock during a release. A side-clamp type binding of the type described is shown in the German specification Offenlegungsschrift 2,649,826.

In the heretofore proposed side-clamp type step-in binding in which the boot-actuated part of the step-in mechanism is located in a position to be contacted by the sole of the ski boot generally rearward of the toe and forward of the rear of the heel of the boot, there is provided a step-in member which is movably mounted in a hole provided therefore in a housing of the binding. In this step-in mechanism the step-in member is provided with a surface for engaging a facing surface on a part of the movable clamping members. To manually cock the binding prior to entry of a ski boot therein, a force unit comprising a spring member is moved to a raised position for removing the clamping force from the clamping members. With the clamping force removed from the clamping members, the step-in member, which is itself spring-loaded, is moved to a raised position wherein the engaging surface on the step-in member engages the facing surface on the clamping members. Thereafter, as the force unit is moved to its clamping position, the full force of the force unit is brought to bear on the step-in member. The binding at this point is prepared for entry.

To enter the binding, a skier places his or her ski boot in skiing position over the step-in member and, pressing down, moves the step-in member downwardly into the housing. As the step-in member is moved downwardly into the housing, the step-in member disengages from the clamping members, allowing the clamping members to engage the ski boot or other clamp-receiving means with the full clamping force of the force unit.

It is also possible to cock or reset the binding during an involuntary release. This occurs when, during an involuntary release, the clamping members open against the force of the spring member and allow the step-in member to move to its cocked position relative to the housing under the force of its spring member. In either case, when cocked, the full clamping force of the force unit is brought to bear on the step-in member. A step-in binding of this type is described in U.S. Pat. No. 4,063,572, assigned to the applicant of the present application.

In considering the known side-clamp type bindings, with step-in mechanisms, it is seen that both of the prior known type bindings have the disadvantage of having the full clamping force of the force unit applied to the step-in member for a substantial period of time when the binding is cocked. This condition imposes severe mechanical requirements on the various parts of the binding and, in particular, on the mechanical structure of the step-in member and facing surface of the clamping members. The previously described side-clamp bindings with the step-in member located at the heel of the ski boot further suffer from the disadvantage of being more complicated structurally and requiring specially made ski boots having cutouts in the heel portion of the sole thereof for providing clearance for parts of the binding mechanism. In comparison, the side-clamp type binding with the step-in member located in use rearward of the toe and forward of the rear of the heel has a simpler mechanical structure and does not require special ski boots. Also, the latter binding achieves its objectives without interfering with the movement of the ski boot relative to a ski in any direction during shock-absorbing maneuvers or release.

SUMMARY OF THE INVENTION

In view of the foregoing, a principal object of the present invention is a releasable step-in binding with a laterally movable side-clamping member. The side-clamping member is provided with an open position for disengaging a ski boot and a ski, and a closed position for engaging a ski boot and a ski.

In all embodiments of the invention, there is provided, coupled to the side-clamping member, a step-in member. The step-in member is provided to move in response to the pressure of a ski boot being inserted in the binding for moving the movable side-clamping member to its closed position and thereafter, applying to the side-clamping member a clamping force for releasably engaging the ski boot and the ski.

In an embodiment of the invention, according to the above object the means for closing the clamping member and thereafter applying a clamping force to the clamping member comprises a spring member, a connecting member, and means for coupling the connecting member to the step-in member. The step-in member is preferably located in a position to be contacted by the ski boot as the boot is placed in the skiing position. With the ski boot placed in skiing position, a downward movement of the boot against the step-in member will cause the movable side-clamping member to engage the boot at a point rearward of the toe and forward of the rear of the heel of the boot.

In the embodiment discussed above, as the step-in member is moved from its clamp-opened position to its clamp-closed position, the connecting member moves the spring member which, in turn, moves the side-clamping member from its open position to its closed position. After the side-clamping member is in its closed position, further movement of the step-in member to what is conveniently called a clamping force applied position moves the spring member in a manner providing a clamping force on the side-clamping member. Means are also provided for voluntarily disengaging a ski boot and a ski and for adjusting the magnitude of the clamping force clamping a ski boot to a ski.

In one of the embodiments of the invention, the connecting member coupling the step-in member to the spring member is coupled directly to the spring member by means of the clamping force adjusting means.

In another of the embodiments of the invention, the connecting member connecting the step-in member to the spring member is indirectly coupled to the spring member by means of a pivotal linkage assembly.

In the latter embodiment, the movement of the step-in member between its clamp-opened and its clamp-closed positions is transmitted to the side-clamping member through the pivotal linkage assembly. When the step-in member is moved from its clamp-opened position to its clamp-closed position, the connecting member connecting the step-in member to the pivotal linkage assembly begins to straighten and elongate the pivotal linkage assembly, causing it to move the side-clamping member to its closed position. Thereafter, a further movement of the step-in member to its clamping force applied position changes the length of the spring member as in the previously described embodiment so as to apply a clamping force to the side-clamping member.

In both embodiments thus far described, the changing of the length of the spring member comprises compressing the spring member. It is understood, however, that the same forces could be achieved by suitable means for extending the spring member.

As in the previously described embodiment, the embodiment incorporating the pivotal linkage assembly also comprises means for voluntarily moving the side-clamping member from its closed position to its open position.

In all of the embodiments described, a principal advantage of the present invention is due to the fact that none of the elements of the binding is subjected to a clamping force until after the movable side-clamping member is in its closed position. This greatly reduces the mechanical stress placed on the various binding parts and results in a relatively simple, yet highly reliable binding. It also results in a binding that is relatively easy to enter and exit. Indeed, relatively little force is required for entering the binding. This is because it is not necessary to overcome any clamping force to close the binding and once closed, only a minimal, if any, force is required to lock the clamping force unit to the clamping member for opposing any subsequent opening of the clamping member.

BRIEF DESCRIPTION OF THE DRAWINGS

The above and other objects, features and advantages of the present invention will become apparent from the following detailed description of the accompanying drawings in which:

FIG. 12 is a side-elevation view of an alternative step-in member according to the present invention.

FIG. 13 is a bottom plan view of the step-in member of FIG. 12.

FIG. 14 is a rear elevation view of the FIG. 13.

FIG. 15 is a cross-sectional view of an alternative pivotal linkage assembly according to the present invention.

FIG. 16 is a side-elevation view of FIG. 15.

FIG. 17 is a top plan view of a step-in pivotal linkage cup of FIG. 16.

DETAILED DESCRIPTION OF THE DRAWINGS

Figure 1:
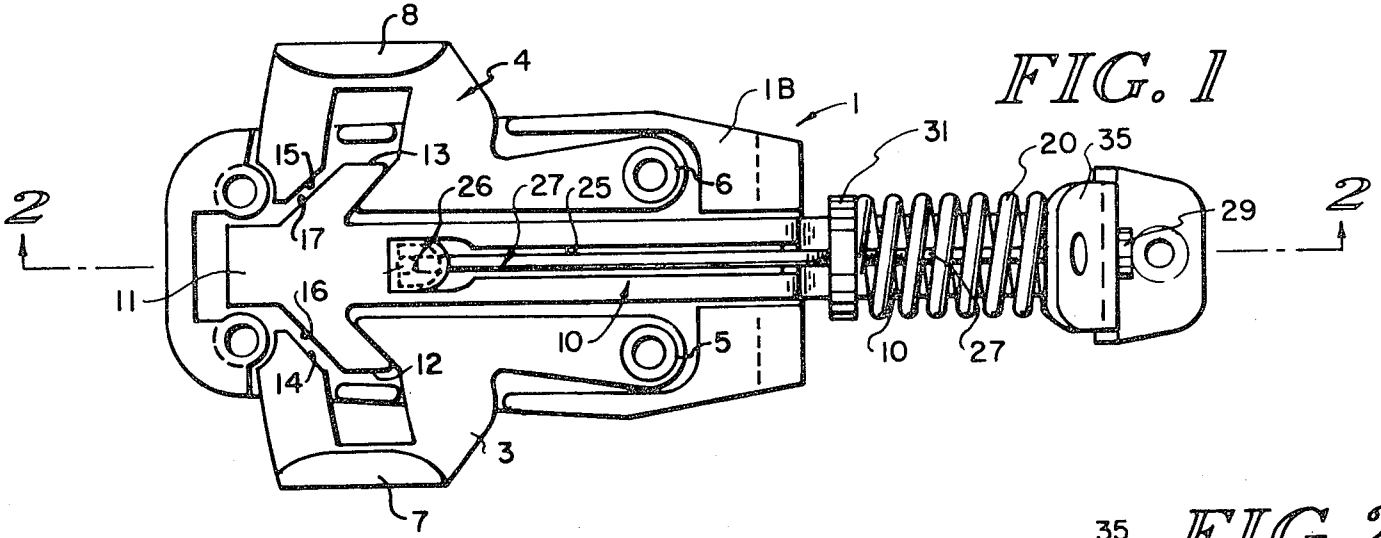
FIG. 1 is a bottom plan view of a binding according to the present invention.

Referring to FIG. 1, there is provided a housing 1. In the housing 1 there is provided an upper or top housing section 1T and a lower or bottom housing section 1B. Movably mounted between the sections 1T and 1B in the housing 1 there is provided a pair of laterally movable side-clamping members 3 and 4. At the rear end of the members 3 and 4, there is provided a pivot post 5 and 6 about which the members 3 and 4 pivot. At the forward end of the members 3 and 4 and at the lateral edges thereof there is provided a pair of jaw members 7 and 8. The jaw members 7 and 8 are provided for engaging a jaw or clamp-receiving member (not shown) for releasably engaging a ski boot and a ski rearward of the toe and forward to the rear of the heel of the boot.

Located between the movable side-clamping members 3 and 4, there is provided a connecting member 10. The connecting member 10 is an elongated member which extends substantially the full length of the binding. At its forward end the connecting member 10 comprises a T-shaped portion 11. Extending rearwardly and outwardly from the T-shaped portion 11, there is provided a pair of arms 12 and 13. The arms 12 and 13 are provided for slidably engaging facing surfaces on interior openings in the side-clamping members 3 and 4. As the connecting member 10 is moved to the right or rearwardly, the clamping members 3 and 4 are pulled inwardly. As the connecting member 10 is moved forwardly or to the left, a pair of surfaces 14 and 15 on the side-clamping members 3 and 4 are engaged by facing surfaces 16 and 17 on the connecting member 10 for moving the side-clamping members 3 and 4 outwardly.

Figure 2:
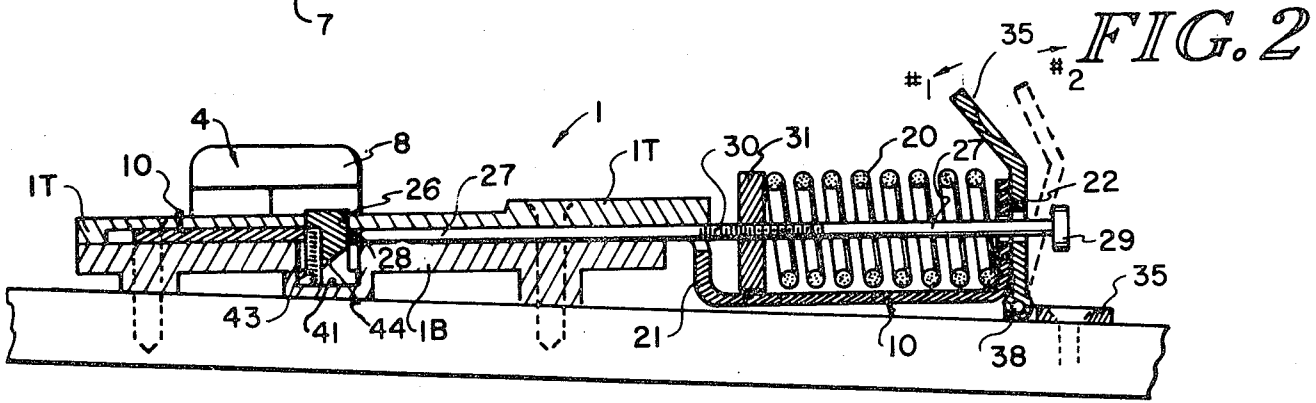
FIG. 2 is a side cross-sectional view taken along the lines 2—2 of FIG. 1.

As shown more clearly in FIG. 2, at the rear end of the housing 1, the connecting member 10 is provided with a section 21 which extends downardly a predetermined distance and rearwardly toward the rear end of the binding for providing a space for receiving a spring member 20. The spring member 20, as a component of a clamping force unit, is provided for applying a clamping force to the side-clamping members 3 and 4, as will be described in more detail below. At its rear end, and extending perpendicular to the horizontal portion of the section 21, the connecting member 10 is provided with an upright member 22.

Extending forwardly from the section 21 to a position just rearward of the outwardly extending arms 12 and 13 of the connecting member 10, there is provided in the connecting member 10 an elongated slot 25. The slot 25 is provided for receiving a step-in member 26 and a connecting member 27. As seen more clearly in FIG. 2, the connecting member 27 extends rearwardly from the step-in member 26 through the center of and coaxial with the spring 20 and through a hole provided therefor in the member 22.

The connecting member 27 extending from the step-in member 26 comprises a generally elongated, rigid, rod-like member. At its forward end the connecting member 27 is provided with a beveled surface 28. At its rear end, the connecting member 27 is provided with a flange 29. Between the surface 28 and the flange 29, the connecting member 27 is provided with threads 30. The threads 30 are provided for threadably receiving a clamping force adjustment knob 31. The clamping force adjustment knob 31 is provided for engaging the opposite end of the spring 20. To adjust the magnitude of the clamping force applied to the side-clamping members 3 and 4, the relative position of the knob 31, and consequently the spring 20 on the connecting member 27 is adjusted by rotating the knob 31 on the connecting member 27.

Located between the upstanding member 22 of the connecting member 10 and the flange 29 at the end of the connecting member 27, there is provided a release pivot member 35.

Figure 4:
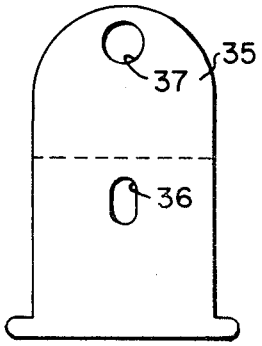
FIG. 4 is a front view of a release pivot lever according to the present invention.

Referring to FIG. 4, there is provided in the release pivot member 35, a hole 36 and a hole 37. The hole 36 is provided for slidably receiving the connecting member 27. The hole 37 is provided for receiving the tip of a ski pole or the like for voluntarily opening the clamping members 3 and 4 and disengaging a ski boot and a ski. At a position intermediate the holes 36 and 37, the release pivot lever 35 is angulated with an upper portion extending forwardly from the bottom portion thereof. As seen more clearly in FIG. 2, the member 35 is located between the upstanding member 22 of the connecting member 10 and the flange 29 for moving the connecting member 10 forwardly and the connecting member 27 rearwardly against the force of the spring 20. In moving the member 35, the member 35 is pivoted about a pin 38 located at its lower end.

Figure 3A:
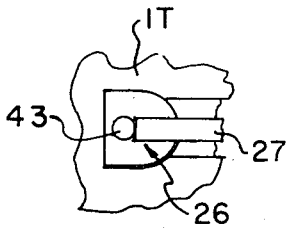
FIG. 3*a* is a bottom plan view of a step-in member of FIG. 1 according to the present invention.
Figure 3B:
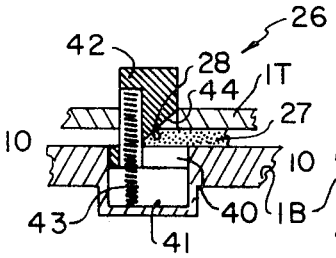
FIGS. 3*b* and 3*c* are side cross-sectional views of the step-in member of FIG. 3*a* in its clamp-opened and clamp-closed positions, respectively.
Figure 3C:
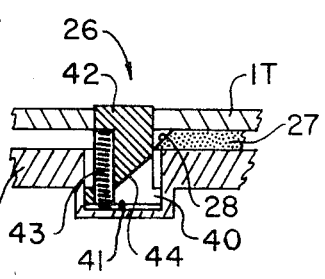

Referring to FIGS. 3*a–d*, there is shown in several views the step-in member 26. As seen more clearly in FIGS. 3*b–d*, the step-in member 26 is provided with a base portion 40. The base portion 40 is adapted to slide freely in a well or recess 41 provided therefor in the bottom section 1B of the housing 1. On the opposite end of the step-in member 26 there is provided a surface 42. The surface 42 is provided for receiving the sole of a ski boot or the like for moving the step-in member 26 from a clamp-opened position, as shown in FIG. 3*b*, to a clamp-closed position, as shown in FIG. 3*c*. To move the step-in member 26 from its clamp-closed position, as shown in FIG. 3*c*, to its clamp-opened position, as shown in FIG. 3*b*, there is provided a spring member 43. Between the base 40 and the upper surface 42, the step-in member 26 is provided with an inclined surface 44. The inclined surface 44 and the inclined surface 28 of a connecting member 27 are facing surfaces.

Figure 3D:
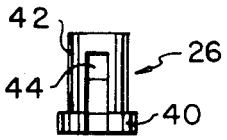
FIG. 3*d* is a front cross-sectional view of the step-in member of FIGS. 3*a*–3*c*.

In operation, a movement of the release pivot lever 35 rearwardly against the flange 29 to the position shown in broken lines in FIG. 2 separates the step-in member 26 and the connecting member 27. The separation of the step-in member 26 and the connecting member 27 releases the step-in member 26 to move from its clamp-closed position, as shown in FIG. 3*d*, to its clamp-opened position, as shown in FIG. 3*b*. With the step-in member 26 in its clamp-opened position, as shown in FIG. 3*b*, the connecting member 27 is moved forwardly beneath the step-in member 26 such that the inclined surfaces 44 and 28 of the step-in member 26 and the connecting member 27 are in a facing relationship. With the connecting member 27 in its most forward position, the spring member 20 is fully extended. With the spring member 20 fully extended, the connecting member 10 coupling the spring 20 to the side-clamping members 3 and 4 is free to move forwardly. With the connecting member 10 moved forwardly, the side-clamping members 3 and 4 are free to move outwardly, for preparing the binding for the entery of a ski boot therein.

With the side-clamping members 3 and 4 moved outwardly, and the step-in member 26 in its clamp-opened position, as shown in FIG. 3*b*, the binding is prepared for the entry of a ski boot therein. As a ski boot is brought to bear on the surface 42 of the step-in member 26, the step-in member 26 is forced downwardly into the well 41. As the step-in member 26 is forced downwardly into the well 41, the facing surface 44 engages the surface 28 on the connecting member 27, moving the connecting member 27 rearwardly. As the connecting member 27 is moved rearwardly, the clamping force adjusting knob 31 presses against the forward end of the spring 20, causing the spring 20 to be pressed against the upstanding member 22 of the connecting member 10. As the spring 20 presses against the upstanding member 22, the connecting member 10 is moved rearwardly. As the connecting member 10 is moved rearwardly, the side-clamping members 3 and 4 are moved to their closed position. Maximum closure of the side-clamping members occurs when the connecting member 27 is moved to a position intermediate the positions shown for the connecting member in FIGS. 3*b* and 3*c*. With the side-clamping members 3 and 4 drawn together to their closest position, a further movement of the step-in member 26 into the well 41 causes the forward end of the connecting member 27 to lock in a friction-tight manner against the vertical side wall of the step-in member 26 and compress the spring 20 against the upstanding member 22 of the connecting member 10.

The magnitude of the compression of the spring member 20 and hence the magnitude of the clamping force imparted to the side-clamping members 3 and 4 depends on the position of the clamping force adjustment member 31 on the connecting member 27. When the step-in member 26 is moved to the fullest extent possible into the well 41, it is in its clamping force applied position. This is the position in which the maximum clamping force for any given position of the force adjustment knob 31 is applied to the side-clamping members 3 and 4.

At this position, the forward edge of the connecting member 27 engages the side wall of the step-in member 26 in a friction-tight manner. The force with which the leading edge of the connecting member 27 engages the side wall of the step-in member 26 is equal to the clamping force. This force retains or holds the step-in member 26 in its clamp-closed position until the release pivot lever 35 is moved rearwardly, separating the two members as initially described.

To open the side-clamping members voluntarily to disengage a ski boot therefrom, the release pivot lever 35 is first moved forwardly against the member 22 and the force of the spring member 20. As the lever 35 is moved forwardly, the connecting member 10 is also moved forwardly opening the side-clamping members. After a ski boot is removed therefrom, the lever 35 is moved rearwardly as previously described to release and reset the step-in member 26 to its clamp-opened position, preparing the binding for re-entry.

Figure 5:
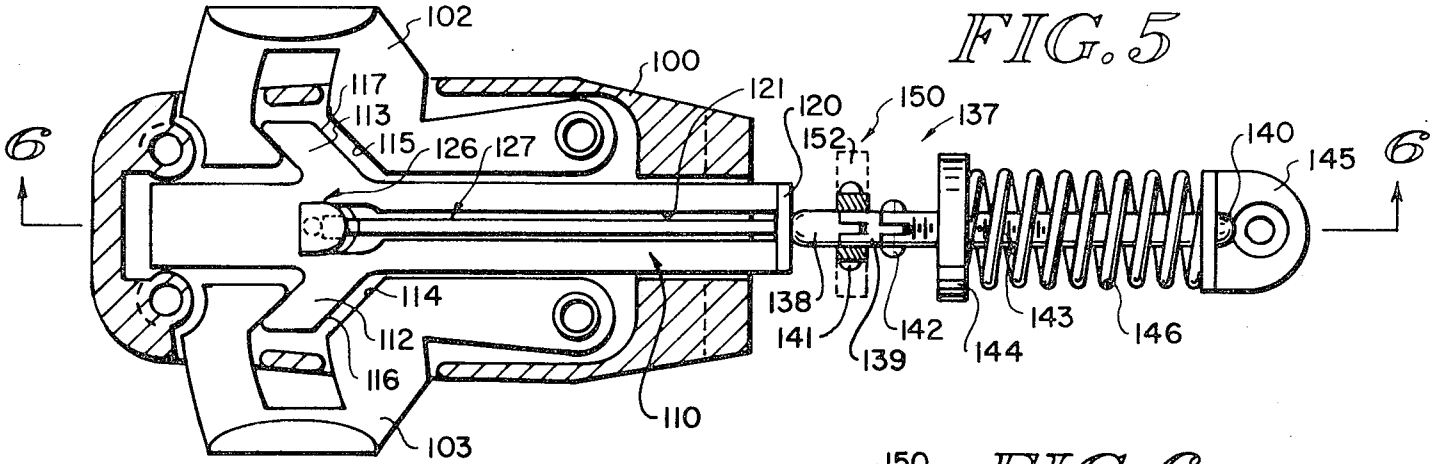
FIG. 5 is a bottom plan view of an alternative embodiment of the present invention.

Referring to FIG. 5, there is provided in another embodiment of the present invention, similar in a number of respects to the embodiment of FIGS. 1–4, a housing 100. In the housing 100 there is provided an upper or top housing section 100T and a lower or bottom housing section 100B. Movably mounted between sections 100T and 100B in the housing 100 there is provided a pair of laterally movable side-clamping members 102 and 103. Movably mounted in the center of the side-clamping members 102 and 103 there is provided a connecting member 110. At its forward end, the connecting member 110 is provided with a pair of outwardly etending arms 112 and 113. The arms 112 and 113 extend generally forwardly for engaging facing surfaces in recesses provided therefor in clamping members 102 and 103. The engaging of the facing surfaces between the arms 112 and 113 and the clamping members 102 and 103 is provided for drawing the clamping members 102 and 103 together as the connecting member 110 is moved forwardly or to the left, as shown in FIG. 5. On the opposite side of the arms 112 and 113, there are provided surfaces 116 and 117. The surfaces 116 and 117 are provided for engaging facing surfaces 114 and 115 on the clamping members 102 and 103 for moving the clamping members 102 and 103 outwardly to their open position as the connecting member 110 is drawn rearwardly or to the right, as shown in FIG. 5. At the rear end of the connecting member 110, the connecting member 110 is provided with an upstanding member 120. Located in the center of the connecting member 110 and extending forwardly from the upstanding member 120 there is provided an elongated slot 121. The slot 121 is provided for receiving a step-in member 126 and a connecting member 127.

The step-in member 126, which is substantially identical to the step-in member 26 of FIGS. *3a–d,* is provided with an inclined surface 129 for engaging a corresponding facing surface 128 on the forward end of the connecting member 127. Forward of the inclined surface 129 there is provided in the step-in member 126 a spring member 133. In the bottom section 100B of the housing 1, there is provided a well or recess 134. The well or recess 134 is provided for receiving the bottom portion of the step-in member 126 when the step-in member 126 is moved from a clamp-opened position to a clamp-closed position. The spring member 133, like the spring member 43, is provided for moving the step-in member 126 from its clamp-closed position to its clamp-opened position, as will be further described.

At the rear end of the connecting member 127 there is provided a pivotal linkage assembly 137. In the linkage assembly 137 there is provided a forward link member 138, an intermediate link member 139 and a spring rod member 140. The link members 138 and 139 are pivotally coupled by means of a pivot pin 141. The link members 139 and spring rod member 140 are pivotally coupled by means of a pivot pin 142.

In the upstanding member 120 there is provided a recess for receiving the forward end of the link member 138. The link member 138 is provided to slidably pivot in the recess, as will as described below.

In the spring rod member 140, there is provided a plurality of threads 143. The threads 143 are provided for threadably receiving a clamping force adjustment knob 144. At the rear end of the rod 140 there is provided a fixed, upstanding member 145. In the member 145, there is provided a hole for slidably receiving the end of the rod 140. Between the member 145 and the clamping force adjustment knob 144, there is provided a spring 146. The spring 146 is provided for providing a clamping force.

At the rear end of the connecting member 127, the connecting member 127 is provided with a beveled surface 147. The beveled surface 147 is provided for moving the link members 138 and 139 of the linkage assembly 137 from a clamp-opened position to a clamp-closed postion, as will be further described below.

Coupled to the linkage assembly 137 there is provided a T-shaped pivot linkage assembly release member 150.

Figure 8:
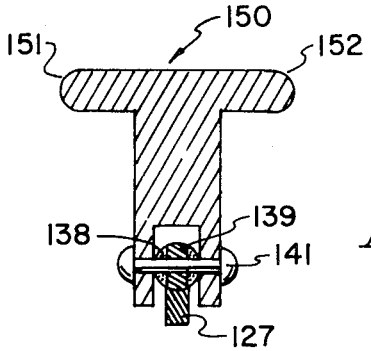
FIG. 8 is a front elevation view of a clamp release member of the embodiment of FIGS. 5–6 according to the present invention.

Referring to FIG. 8, there is provided in the release member 150 a pair of outwardly extending arms 151 and 152. Arms 151 and 152 extend outwardly from the top of the member 150. At its bottom or lower end, the member 150 is coupled to the link member 138 and 139 of the linkage assembly 137 by means of the pivot pin 141.

The operation of the apparatus of FIGS. 5–8 may now be described.

If the step-in member 126 is initially assumed to be in its clamp-opened position, the step-in member 126 is in a raised position, as shown in FIG. *3a* for the member 26 of the apparatus of FIGS. 1–4. With the step-in member 126 in its raised position, and held there at least temporarily by the spring member 133, the connecting member 127 is moved to its forwardmost or clamp-opened position. With the connecting member 127 in its clamp-opened position, the connecting member 127 is moved forwardly or to the left of the position shown in FIG. 6. With the connecting member 127 in its clamp-opened position, the linkage assembly 137, comprising the linking members 138, 139 and 140, are moved to their clamp-opened position in which the spring member 146 is relaxed or fully extended, as shown in FIG. 7.

Figure 6:
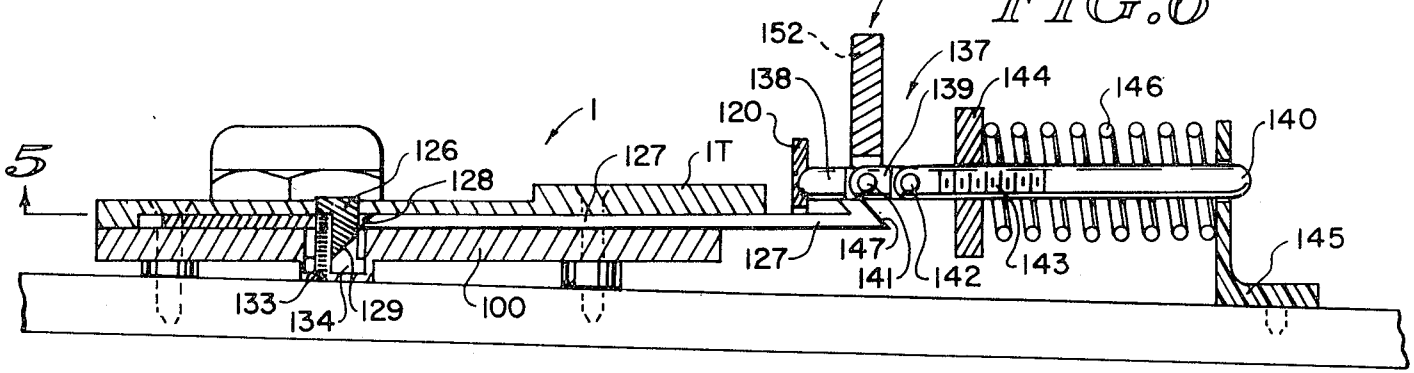
FIG. 6 is a cross-sectional view taken along the lines 6—6 of FIG. 5.
Figure 7:
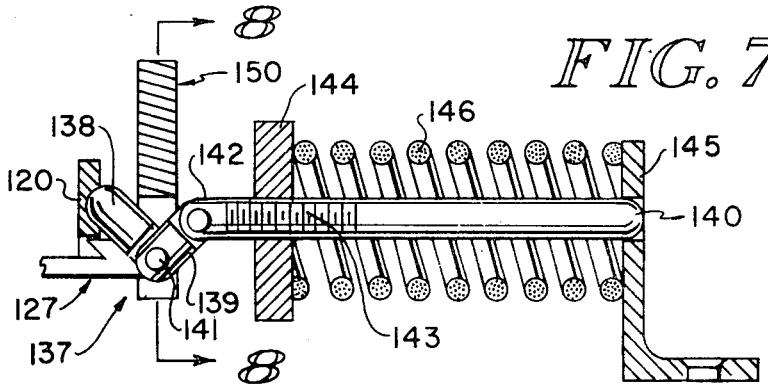
FIG. 7 is a side elevation view of the pivotal linkage assembly of FIGS. 5 and 6 in its clamp-opened position according to the present invention.

To enter the binding of FIGS. 5 and 6, a skier places a ski boot in a skiing position over the step-in member 126. As the ski boot is brought to bear on the top of the step-in member 126, the step-in member is forced downwardly into the well 134 provided therefor in the bottom section 1B of the housing 1. As the step-in member 126 is moved downwardly into the housing 1, the connecting member 127 is pushed rearwardly by the facing surfaces 128 and 129. As the connecting member 127 is pushed rearwardly, the inclined surface 147 at the rear end of the connecting member 127 engages the link member 138 of the pivotal linkage assembly 137. As the connecting member 127 engages the link member 138, the link member 138 is raised, causing the linkage assembly 137 to begin straightening out or elongating. The straightening out or elongation of the linkage assembly 137 causes the connecting member 110 to be moved forwardly due to the pressure of the link member 138 against the upstanding member 120. As the connecting member 110 is moved forwardly, the clamping members 102 and 103 are caused to be pulled inwardly to their closed position. When the clamping members 102 and 103 have been moved to their fully closed position, the further straightening or elongation of the pivotal linkage assembly by the connecting member 127 results in a compression of the spring member 144 as the adjusting knob 144 is pushed against the spring member 146. Once the linkage assembly 137 is fully extended, as shown in FIG. 6, the full clamping force, depending on the position of the force adjustment knob 144 is applied to the side-clamping members 102 and 103. To adjust the magnitude of the clamping force applied to the side-clamping members 102 and 103, the clamping force adjusting member 144 may be rotated on the rod 140 for changing the compression of the spring member 146.

With the linkage member 137 in its fully extended position, as shown in FIG. 6, the connecting member 127 is free to move rearwardly relative to the step-in member 126. Alternatively, the step-in member 126 and the member 127 are loosely coupled so that the step-in member 126 is free to move to its clamp-opened position under the force of the spring member 133.

To voluntarily open the side-clamping members 102 and 103 and to reset the binding for re-entry following an involuntary release, the release member 150 is pushed downwardly toward the linkage assembly 137. As the release member 150 is pushed downwardly toward the pivotal linkage assembly 137, the linking members 138 and 139 are caused to pivot about their pivot pins 141 and 142. As the linking members 138 and 139 are caused to pivot about their pivot pins 141 and 142, the link member 138 comes into contact with the inclined surface 147 of the connecting member 127. As the link member 138 comes into contact with the inclined surface 147 of the connecting member 127, the connecting member 127 is caused to be moved forwardly. At the same time that the connecting member 127 is caused to move forwardly, the beveled surface 128 at the forward end of the connecting member 127 moves beneath the step-in member 126. As the surface 128 moves beneath the member 126, the spring load is removed from the connecting member 110, thereby unloading the side-clamping members 102 and 103.

Figure 9:
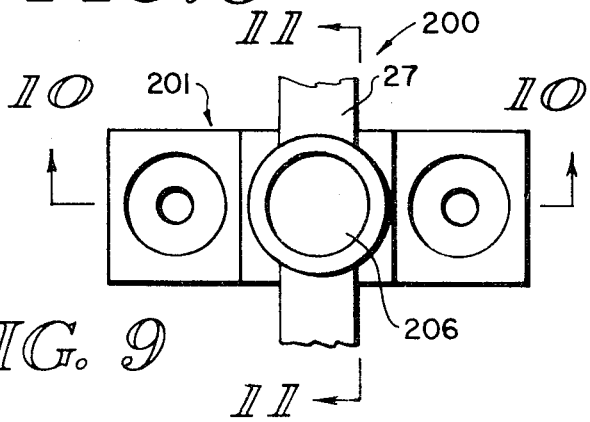
FIG. 9 is a top plan view of an alternative clamp holding and release mechanism for use in the embodiment of FIGS. 1 and 2 according to the present invention with the connecting member omitted for clarity.
Figure 10:
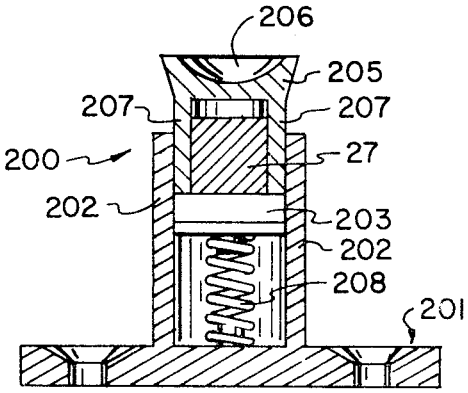
FIG. 10 is a cross-sectional view of FIG. 9.
Figure 11:
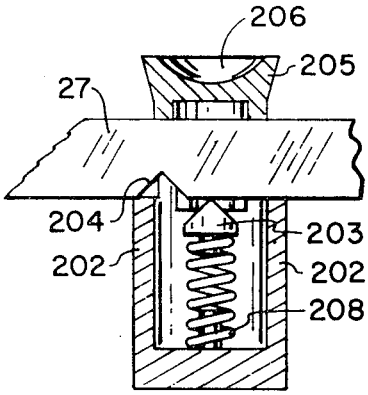
FIG. 11 is a side-elevation view of FIG. 10.

Referring to FIGS. 9, 10 and 11, there is provided an alternative mechanism for applying a clamping force on the side-clamping members 3 and 4 of the apparatus of FIGS. 1–4. As seen in FIGS. 9–11, the mechanism is a locking mechanism designated generally as 200. In the mechanism 200, there is provided a base 201 for mounting the mechanism in a location replacing the release lever 35. Extending upwardly from the base 201, there is provided a pair of frame members 202. The frame members 202 are provided for supporting a sliding blade member or pawl 203. The pawl 203 is provided for releasably engaging a notch or detent 204 in the connecting member 27. Extending upwardly from the frame members 202, there is provided a step-in cup member 205. The step-in cup member 205 is provided at its upper end with a recess 206. Extending downwardly along opposite sides of the connecting member 27 from the base of the cup portion 206, there is provided a pair of spaced leg members 207. The leg members 207 are provided for engaging the blade or pawl 203 for moving the blade or pawl 203 downwardly against the force of a spring member 208 for removing the blade or pawl 203 from the detent 204.

As previously indicated, the mechanism 200 may be used in lieu of the release lever 35 in the apparatus of FIGS. 1 and 2. When used in lieu of the release lever 35, the mechanism 200 is typically mounted at the rear of the binding and the location of the lever 35. If necessary, the connecting member 27 is made somewhat longer than necessary when using the release lever 35 to provide sufficient clearance due to the somewhat larger dimensions of the mechanism 200.

The principal advantage of the mechanism 200 is to eliminate the requirement for a friction fit between the connecting member 27 and the wall of the step-in member 26 when the step-in member 26 is in its clamp-closed position.

In use, as the step-in member 26 is moved to its clamp-closed position, the connecting member 27 is moved rearwardly, closing the clamping members 3 and 4 and compressing the spring 20. As the step-in member 26 moves the connecting member 27 rearwardly, the notch 204 is engaged by the pawl 203. When the notch 204 is engaged by the pawl 203, the force unit comprising the spring member 20 is locked to the side-clamping members 3 and 4 for applying a clamping force to the side-clamping members. To release the connecting member 27, as during a voluntary release, a ski pole tip or the like is inserted in the cup 206 to move the cup downwardly. As the cup 206 is moved downwardly, the pawl 203 is removed from the detent 204 releasing the connecting member 27.

Referring to FIGS. 12–14, there is provided an alternative step-in member 226 and connecting member 227. As in the previously described step-in members, the step-in member 226 is provided with a base 228 and an upper surface 229. The base 228 is provided for centering the step-in member 226 in a well or recess 230 provided therefor in the bottom section 1B of the housing 1. The surface 229 is provided for receiving the sole of a ski boot for moving the step-in member 226 between its clamp-opened position and its clamp-closed position. Between the base 228 and the surface 229, the step-in member 226 is provided with an inclined surface 231. The inclined surface 231 is provided for slidably engaging a corresponding facing surface 232 on the connecting member 228.

The principal difference between the step-in member 226 and the step-in members 26 and 126 of the previously described embodiments is that a step-in spring member for moving the step-in member 226 from its clamp-closed position to its clamp-opened position is not required. Instead, the inclined surface of the connecting member 228, when moved to its most rearward position, remains in sliding contact with the inclined surface 231 of the step-in member 226. With the surfaces 231 and 232 in facing relationship, a movement of the connecting member 228 toward the step-in member 226 will cause the step-in member 226 to be raised to its clamp-opened position by the connecting member 228.

Referring to FIGS. 15, 16 and 17, there is shown an alternative linkage assembly release member 250. In the release member 250 there is provided a recess or step-in cup 251. The step-in cup 251 is provided for receiving the tip of a ski pole or the like. Extending from the base of the cup 251, there is provided a pair of spaced leg members 252 and 253. The spaced leg members 252 and 253 are provided for attaching the member 250 to the link members 138 and 139 of the linkage assembly 137.

In operation, with the linkage assembly 137 fully extended, as shown in FIG. 6, a ski pole tip or the like placed in the step-in cup 251 of the member 250 may be used for moving the pivotal linkage assembly downwardly for shortening the linkage assembly, as shown in FIG. 16. As the linkage assembly 137 is moved downwardly, the connecting member 228 is moved forwardly. As the connecting member 228 is moved forwardly, the facing surfaces 231 and 232 on the step-in member 226 and the connecting member 228 move relative to each other, causing the step-in member 226 to be moved upwardly to its clamp-opened position, as represented in FIG. **3*a* for the step-in member 26**.

Several embodiments of a ski binding according to the present invention are disclosed. It is contemplated, however, that still other modifications may be made to the embodiments disclosed without departing from the spirit and scope of the present invention. For example, the force unit for applying a clamping force to the movable side-clamping members is described as comprising a compressible spring member. While a compressible spring member is a convenient means for providing a clamping force, other types of spring members may be used. Indeed, with suitable modifications well within the skill of the art, other types of force units such as electric and magnetic force units may also be used. Accordingly, it is intended that the embodiments disclosed be considered only for purposes of illustrating the invention and that the scope of the invention be determined by reference to the claims hereafter appended and their equivalents.

What is claimed is:

1. In a step-in binding with a movable clamping member having an open position for disengaging a ski boot and a ski and a closed position for engaging a ski boot and a ski, an improvement comprising:

a step-in member; means mounting the step-in member for movement from a clamp-opened position to a clamp-closed position and from the clamp-closed position to a clamping force applied position, said step-in member functioning to be moved into the clamp-closed position and then the clamping force applied position as the ski boot progressively displaces the step-in member;

a connecting member;

means coupling said step-in member and said connecting member;

a spring member;

means coupling said spring member and said connecting member; and means coupling said spring member and said movable clamping member for closing said movable clamping member and thereafter causing said spring member to apply a clamping force to said movable clamping member as said step-in member is moved by said ski boot from said clamp-opened position through said clamp-closed position to said clamping force applied position, there being no substantial clamping force applied by the spring member to said clamping member when said step-in member is in said clamp-open position.

2. An improvement according to claim 1 wherein said step-in member and said connecting member comprise facing inclined surfaces and said means for coupling said step-in member and said connecting member comprise means for slidably engaging said inclined facing surfaces as said step-in member is moved from its clamp-opened to its clamp-closed position.

3. An improvement according to claim 1 comprising means for adjusting the magnitude of said clamping force.

4. An improvement according to claim 1 wherein said means coupling said spring member and said side-clamping member comprises a substantially rigid member.

5. An improvement according to claim 1 wherein said means coupling said spring member and said connecting member comprises means movably coupled to said connecting member for adjusting the magnitude of said clamping force.

6. An improvement according to claim 1 comprising means for voluntarily opening said movable side-clamping member against said clamping force to voluntarily disengage a ski boot and a ski.

7. An improvement according to claim 1 wherein said means coupling said step-in member and said connecting member comprises means for moving said connecting member to a predetermined position for providing said clamping force when said step-in member is moved to its clamping force applied position and comprising means for releasably holding said connecting member in said predetermined position against said clamping force and means for releasing said connecting member from said holding means.

8. An improvement according to claim 7 comprising means for moving said step-in member from its clamp-closed position to its clamp-opened position and wherein said holding means comprises means for holding said step-in member in its clamp-closed position against said step-in member moving means and said releasing means comprises means for releasing said step-in member for movement to its clamp-opened position.

9. An improvement according to claim 1 wherein said means coupling said spring member and said side-clamping member comprises a movable linkage assembly movable between a clamp-opened position and a clamp-closed position for moving said movable side-clamping member to its clamp-closed position and thereafter applying said clamp force thereto as said movable linkage assembly is moved to its clamp-closed position and said means for coupling said connecting member to said step-in member and said spring member comprises means for moving said linkage assembly from its clamp-opened position to its clamp-closed position as said step-in member is moved from its clamp-opened position to its clamp-closed position.

10. An improvement according to claim 9 wherein said means coupling said step-in member and said connecting member comprises means for moving said connecting member between a clamp-opened position and a clamp-closed position as said step-in member is moved from its clamp-opened position to its clamp-closed position and said means for moving said linkage assembly from its clamp-opened position to its clamp-closed position comprises means on said connecting member for slidably engaging said linkage assembly as said connecting member is moved to its clamp-closed position.

11. An improvement according to claim 10 wherein said step-in member and said connecting member comprise inclined facing surfaces and said means for moving said connecting member comprises means for slidably engaging said facing surfaces.

12. An improvement according to claim 10 comprising means for moving said linkage assembly from its clamp-closed position to its clamp-opened position.

13. An improvement according to claim 9 comprising means for adjusting the magnitude of said clamping force.

14. In a step-in ski binding for securing a ski boot to a ski rearward of the toe and forward of the rear of the heel with an engaging member having an opened condition for disengaging the ski boot and the ski and a closed condition for engaging the ski boot and the ski, an improvement comprising:

a step-in member having an opened condition, a closed condition and an engaging-force-applied condition separably coupled to said engaging member, said step-in member functioning to be moved into the closed condition and then the engaging-force-applied condition as the ski boot progessively displaces the step-in member;

means for changing said engaging member from its opened condition to its closed condition as said step-in member is changed from its opened condition to its closed condition; means for providing an engaging force; and means for applying said engaging force to said engaging member as said step-in member is further actuated by said ski boot from its closed condition to its engaging-force-applied condition, there being no substantial said engaging force on the engaging member acting to move the engaging member to its closed conditions when said step-in member is in said opened condition.

15. An improvement according to claim 14 comprising means for adjusting the magnitude of said engaging force.

16. An improvement according to claim 14 wherein said engaging-force-providing means comprises mechanical means and said means for applying said engaging force to said engaging member comprises means for adjusting said mechanical means to change the magnitude of the engaging force applied to said engaging means.

17. An improvement according to claim 16 wherein said mechanical means comprises a spring member.

18. An improvement according to claim 14 wherein said step-in member comprises a movable step-in member, said open, closed and engaging-force-applied conditions comprise a clamp-open position, a clamp-closed position and a clamping-force-applied position; said engaging member comprises a clamping member having a clamp-open position, a clamp-closed position and a clamping-force-applied position, and said engaging-force-providing means and said means for applying said engaging force to said engaging member comprises a spring member coupled to said clamping member and means for changing the length of said spring member as said step-in member is moved from its clamp-closed position to its clamping-force-applied position.

19. In a step-in ski binding for securing a ski boot to a ski rearward of the toe and forward of the rear of the heel with an engaging member having an opened condition for disengaging the ski boot and the ski and a closed condition for engaging the ski boot and the ski, an improvement comprising: a step-in member having an opened condition, a closed condition and an engaging-force-applied condition separably coupled to said engaging member; means for changing said engaging member from its opened condition to its closed condition as said step-in member is changed from its opened condition to its closed condition; means for providing an engaging force; and means for applying said engaging force to said engaging member as said step-in member is further actuated from its closed condition to its engaging-force-applied condition, said engaging force providing means comprising a spring member, and said engaging force applying means comprising means for compressing said spring member when said step-in member is activated from its closed condition to its engaging-force-applied condition.

20. In a step-in ski binding for securing a ski boot to a ski rearward of the toe and forward of the rear of the heel with a clamping member having an clamp-open position for disengaging the ski boot and the ski, a clamp-closed position for engaging the ski boot and the ski, and a clamping-force-applied position, an improvement comprising: a movable step-in member having a clamp-open position, a clamp-closed position and a clamping-force-applied position separably coupled to said clamping member; means for changing said clamping member from its open position to its closed position as said step-in member is changed from its open position to its closed position; means for providing a clamping force; and means for applying said clamping force to said clamping member as said step-in member is further actuated from its closed position to its clamping force-applied condition, said clamping-force-providing means and said means for applying said clamping force to said clamping member comprising a spring member coupled to said clamping member and means for changing the length of said spring member as said step in member is moved from its clamp-closed position to its clamping-force-applied position, said length-changing means including a connecting member, and means for moving said connecting member against the force of said spring member as said step-in member is moved from its clamp-closed position to its clamping-force-applied-position.

21. An improvement according to claim 20, wherein said means for changing the length of said spring member comprises means for compressing said spring member.

22. An improvement according to claim 20, wherein said means for changing the length of said spring member comprises: a pivotal linkage assembly coupling said movable clamping member and said spring member having a first length when in a clamp-opened position and a second length when in a clamp-closed position, said second length being longer than said first length for compressing said spring member; and means for moving said pivotal linkage assembly from its clamp-opened position to its clamp-closed position for changing said assembly from its first length to its second length as said step-in member is moved to its clamp-closed and clamping force applied positions.

23. An improvement according to claim 22, wherein said step-in member of said connecting member comprise inclined facing surfaces and means for slidably engaging said facing surfaces as said step-in member is moved to its clamp-closed position and said means for moving said linkage assembly comprises means located on said connecting member for engaging said linkage assembly and moving it from its clamp-opened position to its clamp-closed position.

24. An improvement according to claim 20, including means releasably engaging said connecting member when said connecting member is moved to a predetermined position against the force of said spring member by said step-in member for locking said connecting member in said position and providing said clamping force; and means for voluntarily releasing said connecting member from said locking means for permitting said connecting member to return to its initial position and remove said clamping force from said movable clamping member.

25. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; means coupling said spring member and said movable clamping member for closing said movable clamping member and thereafter applying a clamping force to said movable clamping member as said step-in member is moved from a clamp-opened position through a clamp-closed position to a clamping force applied position; and means for adjusting the magnitude of said clamping force, said adjusting means including means movably coupled to said connecting means for adjusting the relative positions of said spring member and said connecting member.

26. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; and means coupling said spring member and said movable clamping member for closing said movable clamping member and thereafter applying a clamping force to said movable clamping member as said step-in member is moved from a clamp-opened position through a clamp-closed position to a clamping force applied position, said means coupling said spring member and said clamping member comprising a movable linkage assembly movable between a clamp-opened position and a clamp-closed position for moving said movable clamping member to its clamp-closed position and thereafter applying said clamping force thereto as said movable linkage assembly is moved to its clamp-closed position, said means for coupling said connecting member to said step-in member and said spring member comprising means for moving said linkage assembly from its clamp-opened position to its clamp-closed position as said step-in member is moved from its clamp-opened position to its clamp-closed position.

27. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; and means coupling said spring member and said movable clamping member for closing said movable clamping member and thereafter applying a clamping force to said movable clamping member as said step-in member is moved from a clamp-opened position through a clamp-closed position to a clamping force applied position, said means coupling said step-in member and said connecting member comprising means for moving said connecting member to a predetermined position for providing said clamping force when said step-in member is moved to its clamping-force-applied position, and including means for releasably holding said connecting member in said predetermined position against said clamping force and means for releasing said connecting member from said holding means, said step-in member and said connecting member having respective, facing inclined surfaces, said means for moving said connecting member to a predetermined position for providing said clamping force means for slidably engaging said facing surfaces as said step-in member is moved from its clamp-opened position to its clamp-closed position, said means for releasably holding said connecting member in said predetermined position comprises means for releasaby engaging said connecting member and said means for releasing said connecting member from said holding means comprises means for separating said connecting member engaging means and said connecting member.

28. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; and means coupling said spring member and said movable clamping member for closing said movable clamping member and thereafter applying a clamping force to said movable clamping member as said step-in member is moved from a clamp-opened position through a clamp-closed position to a clamping force applied position, said means coupling said step-in member and said connecting member comprising means for moving said connecting member to a predetermined position for providing said clamping force when said step-in member is moved to its clamping force applied position, and including means for releasably holding said connecting member in said predetermined position against said clamping force and means for releasing said connecting member from said holding means, said means for releasably holding said connecting means in said predetermined position comprising means forming a detent in said connecting member and means forming a pawl for releasably engaging said detent.

29. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; and means coupling said spring member and said movable clamping member for closing said movable clamping member and thereafter applying a clamping force to said movable clamping member as said step-in member is moved from a clamp-opened position through a clamp-closed position to a clamping force applied position, said means coupling said step-in member and said connecting member comprising means for moving said connecting member to a predetermined position for providing said clamping force when said step-in member is moved to its clamping force applied position, and including means for releasably holding said connecting member in said predetermined position against said clamping force and means for releasing said connecting member from said holding means, and including means for moving said step-in member from its clamp-closed position to its clamp-opened position, said holding means comprising means for holding said step-in member in its clamp-closed position against said step-in member moving means, said releasing means comprising means for releasing said step-in member for movement to its clamp-opened position, said holding means further including means for frictionally engaging said step-in member and said connecting member, said releasing means further including means for separating said step-in member and said connecting member against said clamping force.

30. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; and means coupling said spring member and said movable clamping member for closing said movable clamping member and thereafter applying a clamping force to said movable clamping member as said step-in member is moved from a clamp-opened position through a clamp-closed position to a clamping force applied position, said means coupling said spring member and said clamping member comprising a movable linkage assembly movable between a clamp-opened position and a clamp-closed position for moving said movable clamping member to its clamp-closed position and thereafter applying said clamping force thereto as said movable linkage assembly is moved to its clamp-closed position and said means for coupling said connecting member to said step-in member and said spring member comprises means for moving said linkage assembly from its clamp-opened position to its clamp-closed position as said step-in member is moved from its clamp-opened position to its clamp-closed position, and including means for adjusting the magnitude of said clamping force, said clamping force adjusting means including means movably coupled to said means for coupling said spring member and said clamping member for adjusting the relative positions of said spring member and said coupling means.

31. An improvement according to claim 30, wherein said means for moving said linkage assembly from its clamp-closed position to its clamp-opened position and said means for moving said connecting member to its clamp-opened position comprises inclined facing surfaces and means for slidably engaging said facing surfaces when said linkage assembly is moved by said linkage assembly moving means to its clamp-opened position.

32. In a step-in binding with a movable clamping member having an open position for disengaging a ski boot and a ski and a closed position for engaging a ski boot and a ski, an improvement comprising: a step-in member; a connecting member; means coupling said step-in member and said connecting member; a spring member; means coupling said spring member and said connecting member; and means coupling said spring member and said movable clamping member for closing said movable clamping member and thereafter applying a clamping force to said movable clamping member as said step-in member is moved from a clamp-opened position through a clamp-closed position to a clamping force applied position, said means coupling said spring member and said clamping member comprising a movable linkage assembly movable between a clamp-opened position and clamp-closed position for moving said movable clamping member to its clamp-closed position and thereafter applying said clamping force thereto as said movable linkage assembly is moved to its clamp-closed position, said means for coupling said connecting member to said step-in member and said spring member comprising means for moving said linkage assembly from its clamp-opened position to its clamp-closed position as said step-in member is moved from its clamp-opened position to its clamp-closed position, said means coupling said step-in member and said connecting member comprising means for moving said connecting member between a clamp-opened position and a clamp-closed position as said step-in member is moved from its clamp-opened position to its clamp-closed position, said means for moving said linkage assembly from its clamp-opened position to its clamp-closed position comprising means on said connecting member for slidably engaging said linkage assembly as said connecting member is moved to its clamp-closed position, and including means for moving said linkage assembly from its clamp-closed position to its clamp-opened position, and including means coupling said linkage assembly and said connecting member for moving said connecting member to its clamp-opened position as said linkage assembly is moved from its clamp-closed position to its clamp-opened position, and means for moving said step-in member from its clamp-closed position to its clamp-opened position as said connecting member is moved by said connecting member moving means to its clamp-opened position.

* * * * *